United States Patent [19]

Palvölgyi

[11] Patent Number: 4,936,611

[45] Date of Patent: Jun. 26, 1990

[54] HOOD LATCH

[75] Inventor: Sandor Palvölgyi, Newmarket, Canada

[73] Assignee: Magna International Inc., Ontario, Canada

[21] Appl. No.: 314,078

[22] Filed: Feb. 3, 1989

[30] Foreign Application Priority Data

Feb. 3, 1988 [CA] Canada ..... 558059

[51] Int. Cl.[5] ..... E05C 3/26

[52] U.S. Cl. ..... 292/28; 292/DIG. 14; 292/216

[58] Field of Search ..... 292/28, 48, 216, 201, 292/DIG. 14, DIG. 65

[56] References Cited

U.S. PATENT DOCUMENTS

| | | | |
|---|---|---|---|
| 3,905,624 | 9/1975 | Fujita | 292/DIG. 14 X |
| 4,172,768 | 10/1979 | Cerdan | 292/216 |
| 4,593,945 | 6/1986 | Arute et al. | 292/216 X |
| 4,756,562 | 7/1988 | Foster et al. | 292/28 |

*Primary Examiner*—Richard E. Moore
*Attorney, Agent, or Firm*—Ivor M. Hughes

[57] ABSTRACT

A latch mechanism including: a mounting plate carrying a slot having a bottom and mouth, the latch mechanism having disposed therewith a pivotably biased pawl mechanism comprising a top arm portion for pivoting from a position over the slot to a position spaced from it, the pawl having a bottom arm portion, and a follower mechanism for positioning the pawl with respect to the slot of the mounting plate, the pawl mechanism having a primary pivot about which it normally pivots or rotates and a secondary safety pivot about which the pawl is able to rotate if the primary pivot breaks and which secondary safety pivot does not interfere with any normal operation motion, the latch mechanism having disposed therewith a ratchet mechanism biased for rotation and carrying a notch having a mouth and control mechanism for controlling the position of the pawl mechanism with respect to the slot when the control mechanism of the ratchet engages the follower mechanism of the pawl, the latch mechanism having disposed therewith stop mechanism for stopping rotation of the ratchet mechanism with the mouth of the notch proximate the mouth of the slot both directed towards the top arm portion of the pawl, the top arm portion normally positioned over the slot and being precluded from movement away from the slot unless the mouth of the notch and mouth of the slot are both directed towards the top arm portion.

11 Claims, 8 Drawing Sheets

HOOD LATCH

FIELD OF INVENTION

This invention relates to latching mechanisms incorporated within a vehicle for use in retaining for example, hood lids potentially incorporating remote actuation.

BACKGROUND OF INVENTION

Many latching mechanisms have been proposed for securing hoods to the car body. Today with the emphasis on economy, proposals have attempted to simplify the mechanism. However, in the search for greater economy and simplicity, safety may be jeopardized. For example, where the latching mechanisms are frozen, parts may be frozen in a non-securing position and when the latch may be thought by the driver occupant to be fully secured, it may in fact not be so and the hood may suddenly fly open causing a very dangerous situation. These and other such like situations must be prevented.

U.S. Pat. No. 3,565,476 teaches a hood latch mechanism of complicated construction incorporating four separate components unlatched by a solenoid, having primary and secondary latching means released by a solenoid via a primary release lever engaging a pawl detent.

U.S. Pat. No. 4,203,621 discloses a latching mechanism having first and second latching means. Neither device is simple nor incorporates a co-operative positive secondary latching means which blocks the guide channel within the U-shaped housing upon accidental release of the striker by the primary latch.

U.S. Pat. No. 4,298,223 and United Kingdom Patent Application 2,061,369 each teach a simplified mechanism having a primary latch with a forwardly-biased secondary keeper preventing the primary latch from releasing until such time as the secondary keeper is disengaged. Again neither device blocks the guide channel within the U-shaped housing upon accidental release of the striker by the latch. Further, in neither device does a cooperative rearward stop mechanism exist for preventing over-rotation and hence potential damage for the ratchet mechanism.

Canadian Letters Patents 966,878 and 655,575 teach a simplified mechanism having a primary latch with a rearwardly-biased secondary keeper which may be remotely actuated, again having the aforementioned deficiency with no safety mechanisms therein incorporated.

Canadian Letters Patent 237,847 embodies a latch which may be used externally or internally again having no provision for accidental release, or co-operative engagement. U.S. Pat. No. 3,378,289 discloses a latch mechanism for hoods and deck latches, each having a rotatable safety catch 108 (see FIG. 2) which co-operates with the actuation means of the device. Further, a stop mechanism arm 50 restricting the movement of latch member 46 is incorporated therein. However, the device has several primary components making the cost of manufacture in today's economy prohibitive. Further, the risk of mechanical failure for the system increases with the number of components thereof.

In Canadian Patent Application Serial Number 521,738 there is disclosed a latch mechanism comprising:

(a) a mounting plate carrying a slot having a bottom and mouth, (b) a pivotably biased pawl mechanism comprising a top arm portion for pivoting from a position over the slot to a position spaced from it, a bottom arm portion and follower means, (c) a ratchet mechanism biased for rotation and carrying a notch having a mouth and control means for controlling the follower means of the pawl mechanism, and (d) stop means for stopping rotation of the ratchet mechanism with the mouth of the notch proximate the mouth of the slot both directed towards the top arm portion of the pawl, the top arm portion normally positioned over the slot and being precluded from movement away from the slot unless the mouth of the notch and mouth of the slot are both directed towards the top arm portion.

The control means for controlling the follower means of the pawl mechanism may comprise a control surface on the ratchet mechanism and the follower means comprises a detent carried at the side edge of the pawl mechanism to engage the control surface to:

(a) lock the ratchet mechanism with any striker in the slot and notch at the bottom of the slot with the top arm covering the slot mouth, and (b) ensure the top arm portion cannot be pushed away from over the slot unless the mouth of the notch and mouth of the slot are both proximate one another and directed toward the top arm portion.

The control means for controlling the follower means may also comprise a control structure or formation carried by the ratchet mechanism (for example a slot formation through the body of the ratchet mechanism, for example a Z-shaped slot) and the follower means comprises a pin carried by the pawl mechanism (in one embodiment, the bottom arm portion).

However, even though the said proposals were improvements over prior art developments, they still had several disadvantages. If the primary pivot of the pawl were to break, the striker could fly up and the hood would be released. It is therefore an object of this invention to provide a latch mechanism of simplified construction which reduces the number of components therein, and provides all the necessary safety attributes, enhancing the locking and mechanical reliability of the latch.

SUMMARY OF INVENTION

According to one aspect of the invention a latch mechanism is provided comprising a mounting plate carrying a slot having a bottom and mouth the latch mechanism having disposed therewith a pivotably biased pawl mechanism comprising a top arm portion for pivoting from a position over the slot to a position spaced from it, the pawl having a bottom arm portion, and follower means, for positioning the pawl with respect to the slot of the mounting plate the pawl mechanism having a primary pivot about which it normally pivots or rotates and a secondary safety pivot about which the pawl is able to rotate if the primary pivot breaks and which secondary safety pivot does not interfere with any normal operation motion, the latch mechanism having disposed therewith a ratchet mechanism biased for rotation and carrying a notch having a mouth and control means for controlling the position of the pawl mechanism with respect to the slot when the control means of the ratchet engages the follower means of the pawl, the latch mechanism having disposed therewith, stop means for stopping rotation of the ratchet mechanism with the mouth of the notch proximate the mouth of the slot both directed towards the top arm portion of the pawl, the top arm portion normally positioned over the slot and being precluded from movement away from the slot unless the mouth of the notch and mouth of the slot are both directed towards the top arm portion According to another aspect of the invention there is provided a latch mechanism with an operative cable for actuating the latch mechanism to release a striker to a raised position, the latch mechanism comprising a mounting plate carrying a slot having a bottom and mouth, the latch mechanism having disposed therewith a pivotably biased pawl mechanism comprising a top arm portion for pivoting from a position over the slot to a position spaced from it, the pawl having a bottom arm portion, and follower means, for positioning the pawl with respect to the slot of the mounting plate the pawl mechanism having a primary pivot about which it normally pivots or rotates and a secondary safety pivot about which the pawl is able to rotate if the primary pivot breaks and which secondary safety pivot does not interfere with any normal operation motion, the latch mechanism having disposed therewith a ratchet mechanism biased for rotation and carrying a notch having a mouth and control means for controlling the position of the pawl mechanism with respect to the slot when the control means of the ratchet engages the follower means of the pawl the latch mechanism having disposed therewith, stop means for stopping rotation of the ratchet mechanism with the mouth of the notch proximate the mouth of the slot both directed towards the top arm portion of the pawl the latch mechanism having disposed therewith, a safety device securing the operative cable to the pawl mechanism which device permits actuation of the latch mechanism to only release the striker to a raised position but precludes any further operation of the cable to release the striker from the latch mechanism, the top arm portion normally positioned over the slot and being precluded from movement away from the slot unless the mouth of the notch and mouth of the slot are both directed towards the top arm portion.

According to another aspect of the invention there is provided a latch mechanism with an operative cable for actuating the latch mechanism to release the striker to a raised position, the latch mechanism comprising a mounting plate carrying a slot having a bottom and mouth, the latch mechanism having disposed therewith a pivotably biased pawl mechanism comprising a top arm portion for pivoting from a position over the slot to a position spaced from it, the pawl having a bottom arm portion and follower means, for positioning the pawl with respect to the slot of the mounting plate, the latch mechanism having disposed therewith a ratchet mechanism biased for rotation and carrying a notch having a mouth and control means for controlling the position of the pawl mechanism with respect to the slot when the control means of the ratchet engages the follower means of the pawl the latch mechanism having disposed therewith stop means for stopping rotation of the ratchet mechanism with the mouth of the notch proximate the mouth of the slot both directed towards the top arm portion of the pawl, the latch mechanism having disposed therewith a safety device securing the operative cable to the pawl mechanism which devices permits actuation of the latch mechanism to only release the striker to a raised position but precludes any further operation of the cable to release the striker from the latch mechanism, the top arm portion normally positioned over the slot and being precluded from movement away from the slot unless the mouth of the notch and mouth of the slot are both directed towards the top arm portion According to another aspect of the invention, the control means of the ratchet for engaging the follower means of the pawl mechanism further comprises a control surface on the ratchet mechanism and the follower means, the pawl further comprises a detent carried at the side edge of the pawl mechanism to engage the control means, the follower means to lock the ratchet mechanism with any striker in the slot and notch at the bottom of the slot with the top arm covering the slot mouth, and the control means to ensure the top arm portion cannot be pushed away from over the slot unless the mouth of the notch and mouth of the slot are both proximate one another and directed toward the top arm portion.

According to another aspect of the invention a latch mechanism is provided comprising a mounting plate carrying a slot having a bottom and mouth; the latch mechanism having a pivotably-biased pawl mechanism having a top arm portion (for pivoting from a position over the slot to a position spaced from it), a bottom arm portion, and follower and engaging means or positioning the pawl with respect to the slot of the mounting plate; the latch mechanism having a ratchet mechanism biased for rotation and carrying a notch having a mouth (the notch for receiving a striker) and control means for controlling the position of the pawl mechanism with respect to the slot when the control means of the ratchet engages the follower engaging means of the pawl, the plane of the ratchet in one embodiment lying in the same plane as the pawl mechanism the latch mechanism having disposed therewith stop means to stop the rotation of the ratchet mechanism, the ratchet mechanism for guiding the striker to proximate the bottom of the slot in one embodiment so that the detent of the pawl mechanism engages a detent of the ratchet mechanism so that the ratchet mechanism is precluded from rotating to release the striker, the arm on the top of the pawl mechanism normally positioned over the slot and being precluded from movement away from the slot unless the mouth of the notch and mouth of the slot are both directed towards the top arm portion (in one embodiment, aligned), the improvement comprising the pawl mechanism having a primary pivot about which it normally pivots or rotates and a secondary safety pivot about which the pawl is able to rotate if the primary pivot breaks and which secondary pivot does not interfere with any normal operation motion, and having a safety device securing the operative cable to the pawl mechanism which device permits only release of the striker to a raised position when the cable is activated but precludes any further operation of the cable to release the striker from the latch mechanism.

Thus a latch mechanism is provided whereby a striker is secured by a latch mechanism in a manner precluding accidental release of the striker in a simple, efficient, yet cost-effective manner.

Preferably, the spring means to bias the pawl mechanism to pivot the top of the pawl mechanism towards the slot comprises a bending coil spring secured to the pawl mechanism about the pivot of the pawl and at the edge of the pawl mechanism remote the detent to urge the top arm of the slot. Preferably spring means are provided to bias the ratchet mechanism towards an elevated portion about a pivot of the ratchet mechanism, the spring means preferably comprising a bending coil spring secured to the ratchet mechanism about the pivot of the ratchet mechanism. The bending coil spring is chosen to enable it to lift the striker and the ratchet mechanism when the pawl mechanism is released by actuating the operative cable.

In one embodiment the secondary safety pivot comprises a pin, rivet, bolt or the like secured to the mounting plate and passing through a curved slot having its center of curvature at the primary pivot. In this case the pin, rivet, bolt or the like has a head greater in diameter than the width of the slot to maintain the connection to the mounting plate at all times. The curved slot is of such length to permit the pawl mechanism to rotate about the primary pivot from a position overlying the slot of the mounting plate to a position moved away from over the mounting plate.

In one embodiment the safety device securing the operative cable to the pawl mechanism comprises a clip to which the operative cable is secured, one end of which is adapted to slide in a slot carried by the pawl, the other end of which engages a stop on the mounting plate precluding any further retraction of the cable when the latch mechanism is activated to preclude the top arm of the pawl mechanism from overlying the slot thereby precluding release of the striker from the latch mechanism.

If the pawl mechanism is ever partially restrained (for example, in freezing weather) in an "open" position without the bent or curved arm at the top of the pawl aligned covering the slot and the striker is pushed into the notch of the ratchet mechanism and the ratchet mechanism is permitted to rotate clockwise, the bottom of the ratchet mechanism engages the arm portion on the bottom of the pawl mechanism and causes the pawl mechanism to pivot to cause the bent arm to extend across the slot precluding the striker from being released until the pawl mechanism is pivoted to remove the bent arm proximate the slot out of alignment with the slot.

BRIEF DESCRIPTION OF THE DRAWINGS

The invention will now be illustrated with reference to the following drawings of a preferred embodiment of the invention in which:

With reference to FIG. 1, latch mechanism 34 is shown for the purpose of securely latching striker assembly 36 secured to the underside of the hood 38 to extend horizontally as shown. Striker assembly 36 comprises horizontally-extending cylindrical portion 40.

Figure 1:
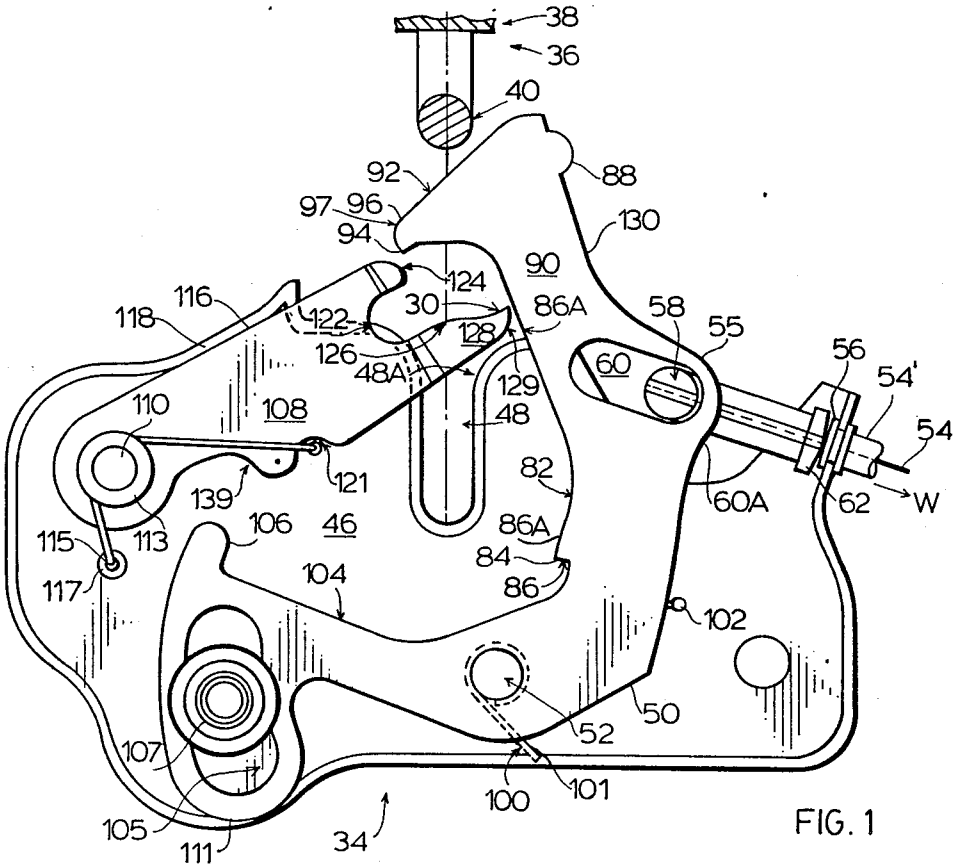
FIG. 1 is a front view of the latch mechanism according to the preferred embodiment of the invention as a hood latch in an open hood state.

Latch mechanism 34 comprises mounting bracket 46 carrying vertically oriented slot 48 which is centrally located in mounting plate 46 and extends from a central middle portion upwardly and has wider mouth portion 48A. Mounting bracket 46 also carries pivotally mounted pawl mechanism 50 pivotally mounted on pivot (pin) 52 to be pivoted by operating cable 54 in the direction W pulling clip 55 towards mounting b shings 56 fastened to mounting plate one end 58 of clip 55 (see FIGS. 8 and 9) is carried in slot 60 of pawl mechanism 50. Operating cable 54 extends from the other end 62 through mounting bushing 56 through outer sleeve or hose 54.

With reference to FIG. 1, pawl mechanism 50 further comprises a central body portion 82 which carries a tooth 84 having on the top surface thereof rounded shoulder 86A and on the underside inwardly-directed straight surface 86. Pawl mechanism 50 carries proximate the top thereof handle 88 comprising a portion of the body angled at right angles (not shown) to the plane of pawl mechanism 50 and top arm portion or safety hook portion 96 carrying upper surface sloped surface 92 extending to the end 94 of pawl mechanism 50 from intermediate portion 96 for the purposes of being engaged by striker 40 causing rotation of pawl mechanism 50 about pivot point 52 to permit entry of the striker mechanism 36 into slot 48. Bending coil spring 100 encompasses pivot 52 with one end 101 supported on mounting plate 46 and the other end 102 abutting the side edge of pawl mechanism 50 remote tooth 84 for urging safety hook portion 96 to overly slot 48 and mouth 48A unless moved laterally using handle 88.

Figure 10:
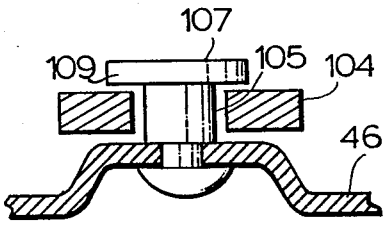
FIG. 10 is a cross-sectional view along the line 10—10 in FIG. 1 looking in the direction of the arrows.

On the bottom end of pawl mechanism 50 is arm 104 which includes a rounded end portion 106 and which arm 104 extends in the same direction as arm 90 away from central portion 82 which central portion extends generally upwardly. Arm 104 carries curved slot 105 (having as its center pivot 52) carrying secondary safety pivot pin 107 (see FIG. 10) comprising head 109 of greater diameter than the width of slot 105 for securing portion 104 of pawl mechanism 50 to mounting plate 46. Slot 105 is of a length to permit safety hook portion 96 to move laterally away from over mouth 48 without pin 107 engaging end 111 of slot 105.

Figure 2:
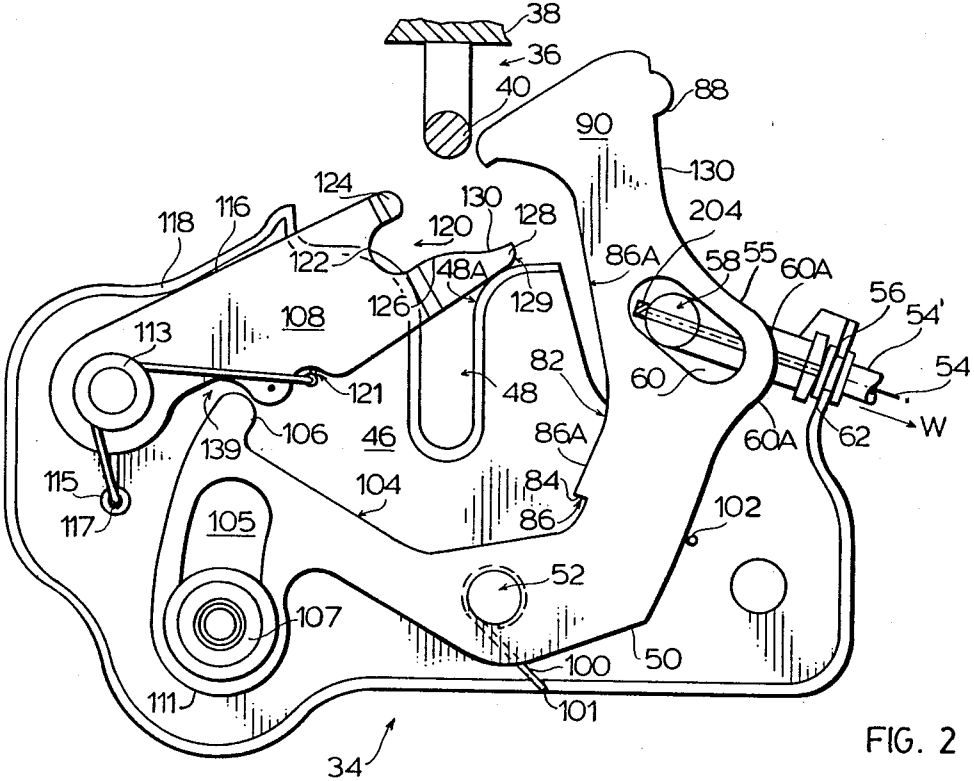
FIG. 2 is a front view of the latch mechanism with the pawl being pushed laterally when the striker passes the pawl mechanism.
Figure 3:
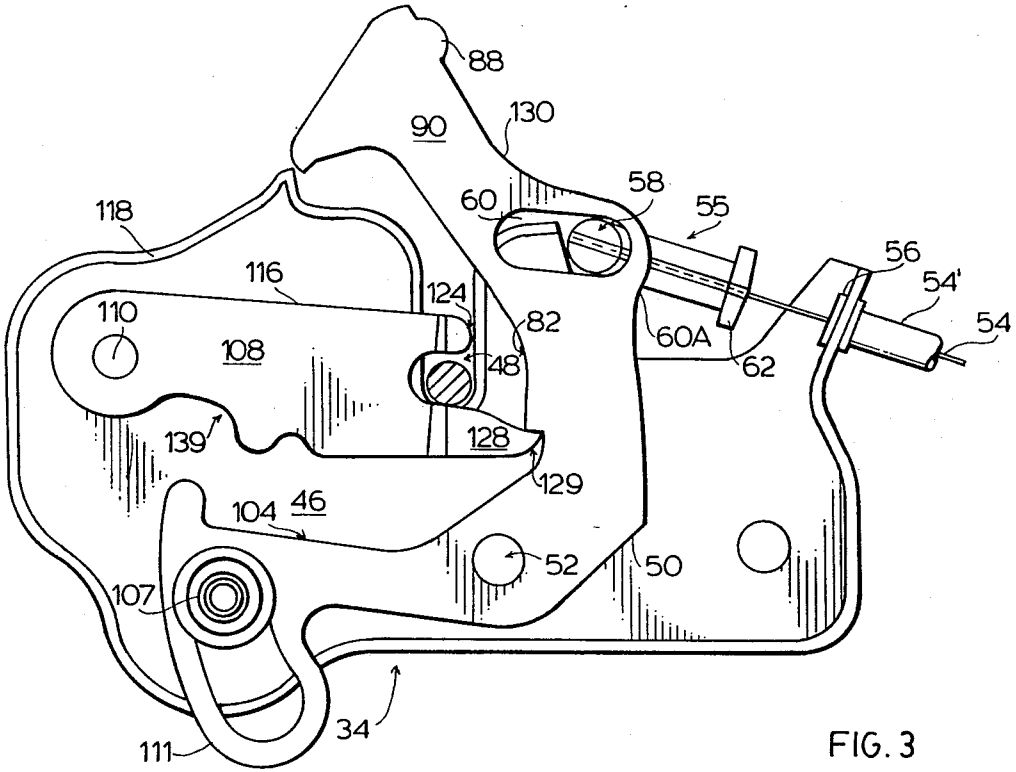
FIG. 3 is a front view of the latch mechanism illustrating the hood latch in a locked position.

Mounting plate 46 also mounts a ratchet mechanism 108 for rotation about pivot pin 110 and is pivotally secured to bending coil spring 113 with one end 115 secured through on aperture 117 in mounting plate 46 and the other end 119 secured into recess on notch 121 on ratchet 108 to constantly urge the ratchet to rotate counterclockwise if permitted to do so from the position shown in FIG. 3. Striker assembly 36 is urged upwardly by the action of spring 113 as the ratchet mechanism rotates, elevating hood 38. Ratchet mechanism 108 also comprises stop 116 for engaging stop 118 a flange on mounting plate 46. Ratchet mechanism 108 carries striker-receiving notch 120 defined by curved portion 122, nose 124 on one side and curved rounded shoulder 126 between portion 122 and tooth 128. Tooth 128 comprises upper straight flat portion 130 for engaging portion 86 of tooth 84 on the pawl as shown in FIG. 2. Ratchet mechanism 108 also carries on the surface below tooth 128 a curved surface 129 "the controlling surface" as shown for the purpose of engaging surface 86A. Thus curved surface 129 riding on surface 86A of pawl mechanism 50 will control the relative positioning of the component parts of pawl mechanism 50 with respect to ratchet mechanism 108 and as will be seen, arm 104 and rounded portion 106 at the end thereof do not engage ratchet mechanism 108 except under special circumstances. Such control by the ratchet mechanism must bring the pawl mechanism 50 into such position that sloped surface 92 is in line with striker portion 40 and overlies slot 48 and slot mouth 48A. Thus surface 86A acts as a cam follower with surface 129 acting as the cam or control.

Figure 7:
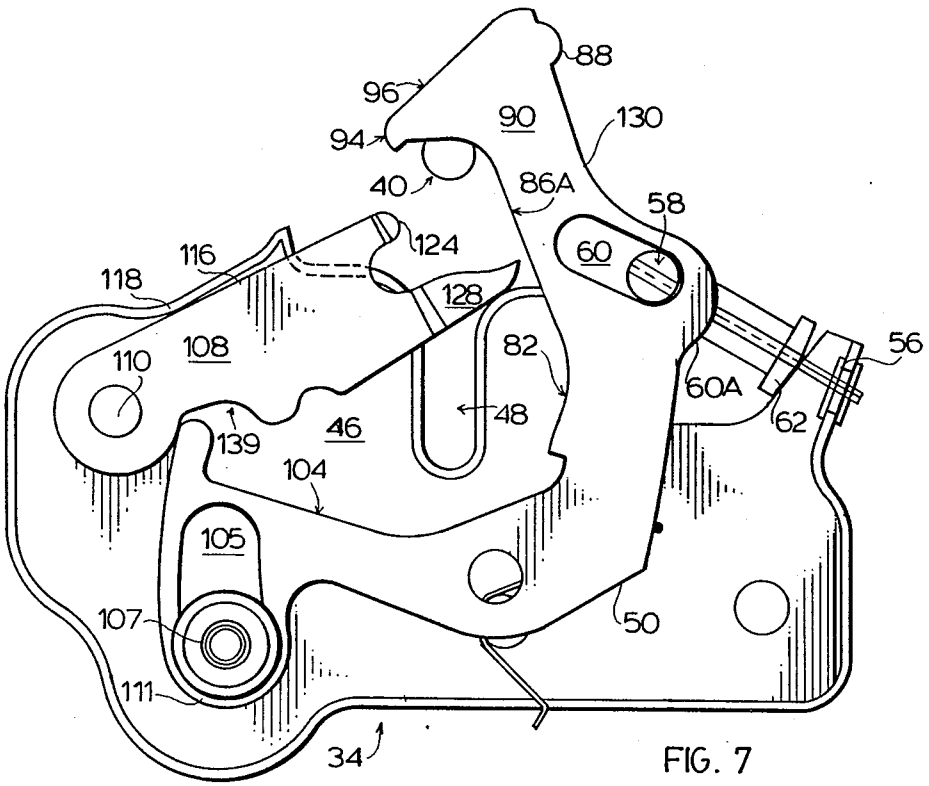
FIG. 7 is a front view of the latch mechanism showing the safety feature of the secondary safety pivot precluding release of the pawl mechanism from over the slot to release the striker when the primary pivot has broken.

With reference to FIG. 7, if pivot pin 52 were to shear, secondary safety pivot pin 107 would become the "pivot" for the pawl mechanism 50. In this regard when pivot 52 shears, ratchet 108 is permitted to rotate counterclockwise lifting tooth 86 of pawl mechanism and thus lifts and rotates pawl mechanism 50 counterclockwise because safety pin 107 becomes the new pivot point. As pawl mechanism is lifted, slot 105 is lifted positioning safety pin 107 at the bottom of slot 105 whereas it continues to act as the "pivot", preventing the pawl mechanism from lifting further.

With reference to FIGS. 1, 2 and 3, the latching of striker 36 is clearly seen. Cylindrical portion 40 of striker 36 is brought to bear on surface 92 of arm portion 96 which causes pawl mechanism 50 to pivot clockwise about pivot 52 until striker 36 passes into the mouth 48A of slot 48 and the mouth of notch 120 and sits on shoulder 126, forcing ratchet mechanism 108 to pivot clockwise around pivot 110.

Except for the instance of the pawl mechanism 50 being frozen in a position not covering slot 48, ratchet mechanism rotates clockwise to a position where cylinder 40 of striker 36 is at the bottom of slot 48 with tooth surface 130 below detent tooth 84. Surface 129 rides against surface 86A positioning safety hook portion 96 at all times over slot 48 (except when cylinder 40 of striker 36 engaged surface 92 and pushed pawl mechanism laterally or clockwise around pivot 52.

In the instance where pawl mechanism 50 is frozen in a position not covering slot 48, surface 139 is pushed onto rounded end portion 106 by bottom arm 104 of pawl mechanism 50. Such contact forces pawl mechanism 50 to rotate counterclockwise positioning safety hook portion 94 over slot 48.

With reference to FIG. 3, striker 36 is in notch 120 at the bottom of slot 48 with tooth 84 engaging tooth 128 preventing relative rotation of ratchet mechanism 108 counterclockwise about pivot pin 110. Arm 90 of pawl mechanism 50 extends over the mouth 48A of slot 48.

Figure 4:
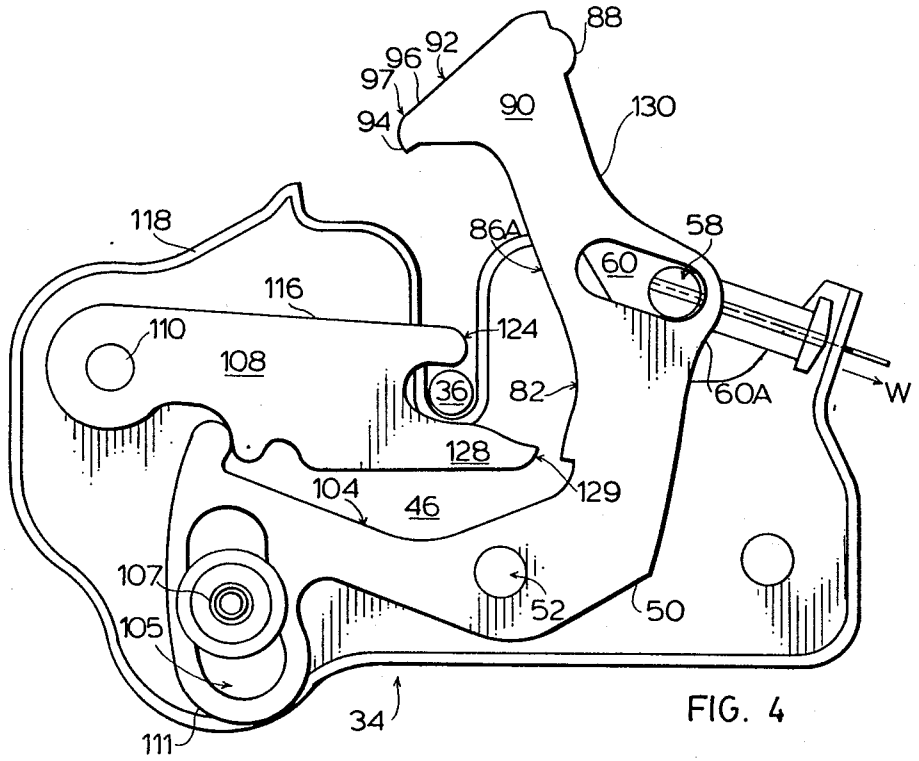
FIG. 4 is a front view of the latch mechanism showing the release of the ratchet mechanism by retraction of the pawl mechanism by the operative cable.
Figure 8:
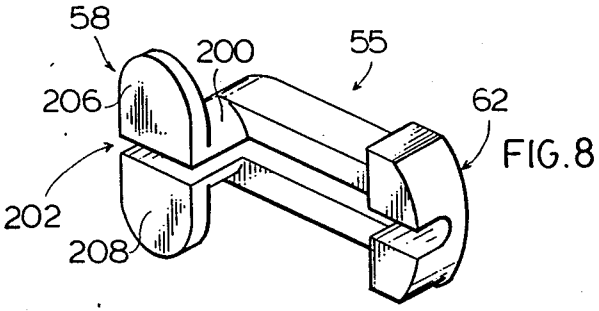
FIG. 8 is a perspective view of a clip used in conjunction with the operative cable and the pawl mechanism.
Figure 9:
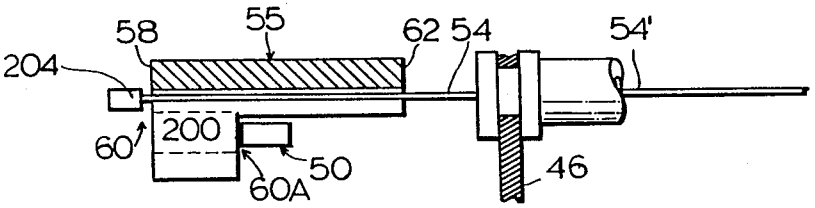
FIG. 9 is a cross-section view of the clip in FIG. 8 taken on the line 9—9 looking in the direction of the arrows mounted for use.

With reference to FIGS. 4 and 8 and 9, actuator 54 has been retracted in general direction W retracting pawl mechanism 50 which pivots about pivot pin 52 withdrawing detent tooth 84 towards actuator 54 away from tooth 128, positioning latch mechanism instantaneously in a position where the ratchet mechanism is now free to rotate counterclockwise to free striker 36 urged to rise by the action of spring 113. As latch mechanism 108 rotates in a counterclockside direction, striker rises in slot 48 with arm 90, including portion 94 still extending over the mouth 48A of slot 48, preventing release of striker 36.

The reason for the continued maintenance of portion 94 extending over slot 48 is the construction of the actuator.

With reference to FIGS. 8 and 9, clip 55 rides in slot 60 and when retracted by pulling actuator 54 in direction "W", cylindrical portion 200 engages the rear end 60A of slot 60 rotating pawl mechanism 50 about pivot 52. The rear end 62 of clip 55 is so constructed that before portion 94 is moved to a position where it does not averlie slot 48, the rear end 62 engages bushing 56 precluding any further motion of pawl mechanism 50 caused by actuation of cable 54.

For securing cable 54 to clip 55 transverse slot 202 is provided to permit insertion of cable 54 into the centre of clip 55. The forward end 54A of cable 54 is pressed into nipple or enlarged member 204, which is larger than the slot opening in which the cable 54 is positioned. Tabs of flanges 206 and 208 carried on one side of projection 200 are provided to lock clip 55 to slide within slot 60. For mounting purposes in slot 60, tabs 206 and 208 are turned 90 degrees, inserted through the slot and returned to their upright mounted position. Cable 54 cannot fall from clip 55 because the open side of slot 202 is partially covered at all times by pawl mechanism 50.

Figure 5:
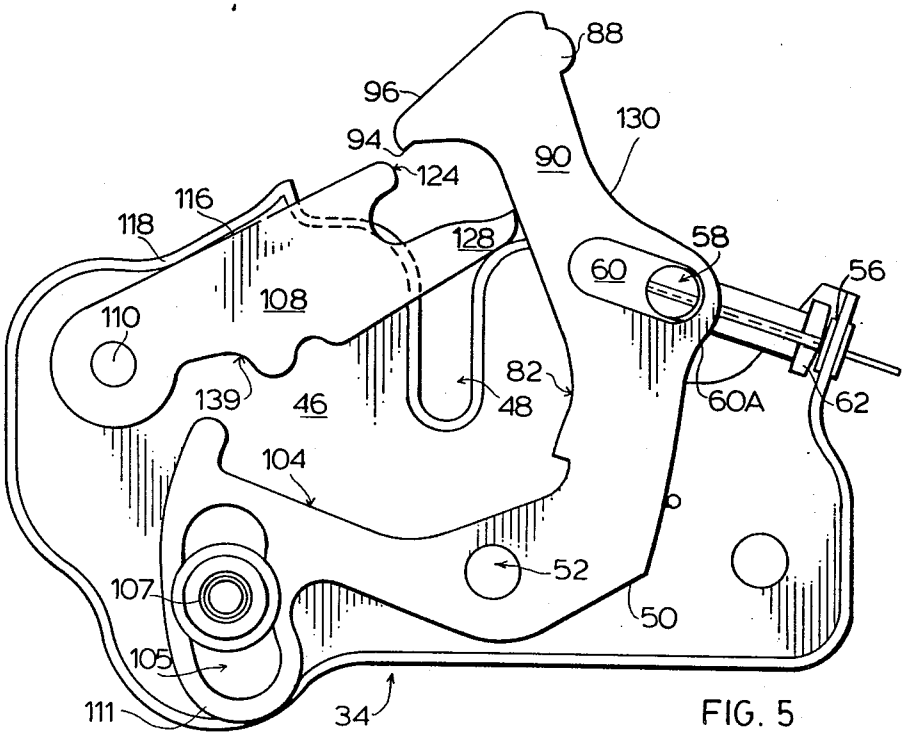
FIG. 5 is a front view of the striker elevated to a raised position after the actuation by the operating cable.
Figure 6:
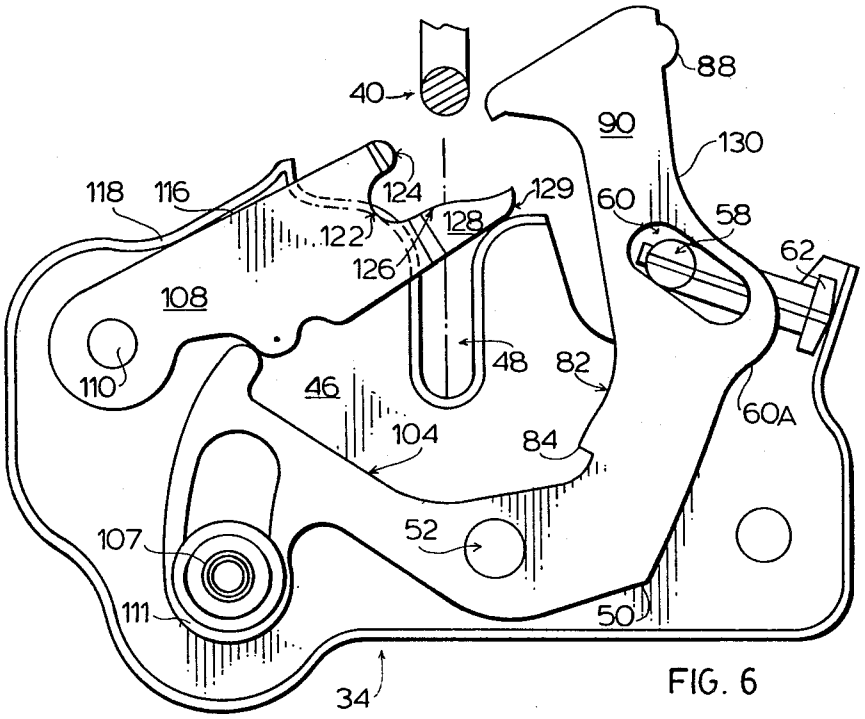
FIG. 6 is a front view of the pawl mechanism being moved laterally from a position over the slot (as for example by grasping a handle) thereby releasing the striker.

With reference to FIGS. 5 and 6, it is clear as ratchet mechanism 108 rotates to cause stop surface 116 to engage stop 118, thereby aligning notch 120 with the mouth 48A of slot 48, striker 36 then moves to the top of the latch mechanism below arm portion 94. By grasping handle 88 and rotating pawl clockwise, portion 94 is moved away from slot 48 and striker 36 is released. As is apparent, pulling on cable 54 would not permit this operation.

With reference to FIG. 7, if pivot pin 52 were to shear, secondary safety pivot pin 107 would become the "pivot" for the pawl mechanism 50. In this regard when pivot 52 shears, ratchet 108 is permitted to rotate counterclockwise lifting tooth 86 of pawl mechanism and thus lifts and rotates pawl mechanism 50 counterclockwise because safety pin 107 becomes the new pivot point. As pawl mechanism is lifted, slot 105 is lifted positioning safety pin 107 at the bottom of slot 105 whereas it continues to act as the "pivot", preventing the pawl mechanism from lifting further.

As many changes can be made to the embodiment of this invention without departing from the scope of the invention, it is intended that all matter contained herein be interpreted as illustrative of the invention and not in a limiting sense.

The embodiments of the invention in which an exclusive property or privilege is claimed are as follows:

1. A latch mechanism comprising a mounting plate carrying a slot having a bottom and mouth, the latch mechanism having disposed therewith a pivotably biased pawl mechanism comprising a top arm portion for pivoting from a position over the slot to a position spaced from it, the pawl having a bottom arm portion and follower means for positioning the pawl with respect to the slot of the mounting plate, the pawl mechanism having a primary pivot about which it normally pivots or rotates and a secondary safety pivot about which the pawl is able to rotate if the primary pivot breaks and which secondary safety pivot does not interfere with any normal operation motion, the latch mechanism having disposed therewith a ratchet mechanism biased for rotation and carrying a notch having a mouth and control means for controlling the position of the pawl mechanism with respect to the slot when the control means of the ratchet engages the follower means of the pawl, the latch mechanism having disposed therewith stop means for stopping rotation of the ratchet mechanism with the mouth of the notch proximate the mouth of the slot both directed towards the top arm portion of the pawl, the top arm portion normally positioned over the slot and being precluded from movement away from the slot unless the mouth of the notch and mouth of the slot are both directed towards the top arm portion.

2. A latch mechanism with an operative cable for actuating the latch mechanism to release a striker to a raised position, the latch mechanism comprising a mounting plate carrying a slot having a bottom and mouth, the latch mechanism having disposed therewith a pivotably biased pawl mechanism comprising a top arm portion for pivoting from a position over the slot to a position spaced from it, the pawl having a bottom arm portion and follower means for positioning the pawl with respect to the slot of the mounting plate, the pawl mechanism having a primary pivot about which it normally pivots or rotates and a secondary safety pivot about which the pawl is able to rotate if the primary pivot breaks and which secondary safety pivot does not interfere with any normal operation motion, the latch mechanism having disposed therewith a ratchet mechanism biased for rotation and carrying a notch having a mouth and control means for controlling the position of the pawl mechanism with respect to the slot when the control means of the ratchet engages the follower means of the pawl the latch mechanism having disposed therewith stop means for stopping rotation of the ratchet mechanism with the mouth of the notch proximate the mouth of the slot both directed towards the top arm portion of the pawl the latch mechanism having disposed therewith, a safety device securing the operative cable to the pawl mechanism which device permits actuation of the latch mechanism to only release the striker to a raised position but precludes any further operation of the cable to release the striker from the latch mechanism, the top arm portion normally positioned over the slot and being precluded from movement away from the slot unless the mouth of the notch and mouth of the slot are both directed towards the top arm portion.

3. A latch mechanism with an operative cable for actuating the latch mechanism to release the striker to a raised position, the latch mechanism comprising a mounting plate carrying a slot having a bottom and mouth, the latch mechanism having disposed therewith, a pivotably biased pawl mechanism comprising a top arm portion for pivoting from a position over the slot to a position spaced from it, the pawl having a bottom arm portion, and follower means for positioning the pawl with respect to the slot of the mounting plate, the latch mechanism having disposed therewith, a ratchet mechanism biased for rotation and carrying a notch having a mouth and control means for controlling the position of the pawl mechanism with respect to the slot when the control means of the ratchet engages the follower means of the pawl the latch mechanism having disposed therewith stop means for stopping rotation of the ratchet mechanism with the mouth of the notch proximate the mouth of the slot both directed towards the top arm portion of the pawl, the latch mechanism having disposed therewith a safety device securing the operative cable to the pawl mechanism which devices permits actuation of the latch mechanism to only release the striker to a raised position but precludes any further operation of the cable to release the striker from the latch mechanism, the top arm portion normally positioned over the slot and being precluded from movement away from the slot unless the mouth of the notch and mouth of the slot are both directed towards the top arm portion.

4. The latch mechanism of claim 1, wherein the control means of the ratchet for engaging the follower means of the pawl mechanism further comprises a control surface on the ratchet mechanism and the follower means of the pawl further comprises a detent carried at the side edge of the pawl mechanism to engage the control means, the follower means to lock the ratchet mechanism with any striker in the slot and notch at the bottom of the slot with the top arm covering the slot mouth, and the control means to ensure the top arm portion cannot be pushed away from over the slot unless the mouth of the notch and mouth of the slot are both proximate one another and directed toward the top arm portion.

5. The latch mechanism of claim 2, wherein the control means of the ratchet for engaging the follower means of the pawl mechanism further comprises a control surface on the ratchet mechanism and the follower means of the pawl further comprises a detent carried at the side edge of the pawl mechanism to engage the control means, the follower means to lock the ratchet mechanism with any striker in the slot and notch at the bottom of the slot with the top arm covering the slot mouth, and the control means to ensure the top arm portion cannot be pushed away from over the slot unless the mouth of the notch and mouth of the slot are both proximate one another and directed toward the top arm portion.

6. The latch mechanism of claim 3, wherein the control means of the ratchet for engaging the follower means of the pawl mechanism further comprises a control surface on the ratchet mechanism and the follower means of the pawl further comprises a detent carried at the side edge of the pawl mechanism to engage the control means, the follower means to lock the ratchet mechanism with any striker in the slot and notch at the bottom of the slot with the top arm covering the slot mouth, and the control means to ensure the top arm portion cannot be pushed away from over the slot unless the mouth of the notch and mouth of the slot are both proximate one another and directed toward the top arm portion.

7. A latch mechanism comprising a mounting plate carrying a slot having a bottom and mouth; the latch mechanism having a pivotably-biased pawl mechanism having a top arm portion, a bottom arm portion, and follower and engaging means for positioning the pawl with respect to the slot of the mounting plate; the latch mechanism having a ratchet mechanism biased for rotation and carrying a notch having a mouth and control means for controlling the position of the pawl mechanism with respect to the slot when the control means of the ratchet engages the follower and engaging means of the pawl, the plane of the ratchet in one embodiment lying in the same plane as the pawl mechanism; the latch mechanism having disposed therewith stop means to stop the rotation of the ratchet mechanism, the ratchet mechanism for guiding the striker to proximate the bottom of the slot so that the detent of the pawl mechanism engages a detent of the ratchet mechanism so that the ratchet mechanism is precluded from rotating to release the striker, the arm on the top of the pawl mechanism normally positioned over the slot and being precluded from movement away from the slot unless the mouth of the notch and mouth of the slot are both directed towards the top arm portion, the improvement comprising the pawl mechanism having a primary pivot about which it normally pivots or rotates and a secondary safety pivot about which the pawl is able to rotate if the primary pivot breaks and which secondary pivot does not interfere with any normal operation motion, and having a safety device securing the operative cable to the pawl mechanism which device permits only release of the striker to a raised position when the cable is activated but precludes any further operation of the cable to release the striker from the latch mechanism.

8. The latch mechanism as in any one of claims 1 to 7 further comprising spring means to bias the pawl mechanism to pivot the top of the pawl mechanism towards the slot comprises a bending coil spring secured to the pawl mechanism about the pivot of the pawl and at the edge of the pawl mechanism remote the detent to urge the top arm of the slot and spring means to bias the ratchet mechanism towards an elevated portion about a pivot of the ratchet mechanism, the spring means comprising a bending coil spring secured to the ratchet mechanism about the pivot of the ratchet mechanism.

9. The latch mechanism as in any one of claims 1 to 7 wherein the secondary safety pivot comprises a pin, rivet, bolt or the like secured to the mounting plate and passing through a curved slot having its centre of curvature at the primary pivot, the pin, rivet, bolt or the like has a head greater in diameter than the width of the slot to maintain the connection to the mounting plate at all times, and the curved slot is of such length to permit the pawl mechanism to rotate about the primary pivot from a position overlying the slot of the mounting plate to a position moved away from over the mounting plate.

10. The latch mechanism as in any one of claims 2 to 7 wherein the safety device securing the operative cable to the pawl mechanism comprises a clip to which the operative cable is secured, one end of which is adapted to slide in a slot carried by the pawl, the other end of which engages a stop on the mounting plate precluding any further retraction of the cable when the latch mechanism is activated to preclude the top arm of the pawl mechanism from overlying the slot thereby precluding release of the striker from the latch mechanism.

11. The latch mechanism as in any one of claims 1 to 7 wherein if the pawl mechanism is ever partially restrained (for example, in freezing weather) in an "open" position without the bent or curved arm at the top of the pawl aligned covering the slot and the striker is pushed into the notch of the ratchet mechanism and the ratchet mechanism is permitted to rotate clockwise, the bottom of the ratchet mechanism engages the arm portion on the bottom of the pawl mechanism and causes the pawl mechanism to pivot to cause the bent arm to extend across the slot precluding the striker from being released until the pawl mechanism is pivoted to remove the bent arm proximate the slot out of alignment with the slot.

* * * * *